US008177343B2

(12) United States Patent
Yoshiike

(10) Patent No.: US 8,177,343 B2
(45) Date of Patent: May 15, 2012

(54) LIQUID TANK WITH VENT-TO-ATMOSPHERE MECHANISM

(75) Inventor: Masataka Yoshiike, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 342 days.

(21) Appl. No.: 12/670,612

(22) PCT Filed: Oct. 8, 2008

(86) PCT No.: PCT/JP2008/068692

§ 371 (c)(1),
(2), (4) Date: Jan. 25, 2010

(87) PCT Pub. No.: WO2009/051149

PCT Pub. Date: Apr. 23, 2009

(65) Prior Publication Data

US 2010/0194830 A1 Aug. 5, 2010

(30) Foreign Application Priority Data

Oct. 18, 2007 (JP) ..... 2007-271659

(51) Int. Cl.
*B41J 2/175* (2006.01)

(52) U.S. Cl. ..... 347/86; 347/84

(58) Field of Classification Search ..... 347/84, 347/85, 86, 87

See application file for complete search history.

(56) References Cited

U.S. PATENT DOCUMENTS

| | | | | |
|---|---|---|---|---|
| 5,781,213 | A | 7/1998 | Ujita et al. | |
| 6,007,193 | A * | 12/1999 | Kashimura et al. | 347/92 |
| 6,022,102 | A | 2/2000 | Ikkatai et al. | |
| 7,325,908 | B2 * | 2/2008 | Katoh et al. | 347/85 |
| 7,645,033 | B2 * | 1/2010 | Bulman et al. | 347/86 |
| 7,661,805 | B2 * | 2/2010 | Usui | 347/92 |
| 2004/0223036 | A1 | 11/2004 | Inoue et al. | |
| 2005/0088494 | A1 | 4/2005 | Shimizu et al. | |
| 2005/0116997 | A1 | 6/2005 | Katoh et al. | |
| 2007/0091154 | A1 | 4/2007 | Katayama et al. | |

FOREIGN PATENT DOCUMENTS

| | | | |
|---|---|---|---|
| EP | 0803364 | A2 | 10/1997 |
| EP | 1525986 | A2 | 10/2004 |
| EP | 1772271 | A2 | 4/2007 |

(Continued)

OTHER PUBLICATIONS

Feb. 28, 2011 European search report in connection with counterpart European patent application No. 08 83 9371.

*Primary Examiner* — Anh T. N. Vo
(74) *Attorney, Agent, or Firm* — Cooper & Dunham LLP

(57) ABSTRACT

A liquid tank includes a vent-to-atmosphere mechanism configured to open and close a vent-to-atmosphere passageway for venting an internal reservoir space connected to a liquid spray head to atmosphere, the vent-to-atmosphere mechanism including a cylindrical member, a valve seat disposed inside the cylindrical member, a valve plug disposed inside cylindrical member and movable to come in contact with or separate from the valve seat, a movable member disposed inside the cylindrical member on an atmosphere side of the valve plug in a slidable manner to cause a movement of the valve plug, the movable member having an outer surface in movable contact with an inner surface of the cylindrical member and having a communication passageway formed therethrough for communication with atmosphere, and a filter member disposed at the communication passageway to capture foreign material.

8 Claims, 10 Drawing Sheets

FOREIGN PATENT DOCUMENTS

| | | |
|---|---|---|
| JP | 2003-1846 | 1/2003 |
| JP | 2003-19813 | 1/2003 |
| JP | 3461282 | 8/2003 |
| JP | 2004-90624 | 3/2004 |
| JP | 2005-59491 | 3/2005 |
| JP | 2005-125741 | 5/2005 |
| JP | 2005-138472 | 6/2005 |
| JP | 2005-169674 | 6/2005 |
| JP | 3772859 | 2/2006 |
| JP | 2006-272900 | 10/2006 |
| JP | 2006-327030 | 12/2006 |
| JP | 2007-210231 | 8/2007 |
| WO | WO2005/075204 A1 | 8/2005 |

* cited by examiner

LIQUID TANK WITH VENT-TO-ATMOSPHERE MECHANISM

TECHNICAL FIELD

The disclosures herein generally relate to liquid tanks and image forming apparatuses, and particularly relate to an image forming apparatus provided with a printhead for spraying liquid droplets and a liquid tank for use in such an image forming apparatus.

BACKGROUND ART

Some image forming apparatus such as a printer, a facsimile machine, a copier, a plotter, and a multifunctional machine may use a printhead comprised of a liquid spray head for spraying liquid droplets to a paper sheet to form an image while shifting the position of the sheet serving as a medium. The term "medium" may hereinafter be referred to as a "paper sheet", but is not intended to limit the type of material used. Other terms such as "record medium", "recording medium", "transfer member", "recording sheet" may as well be used to mean the same thing as the term "medium". By the same token, terms such as "recording" and "printing" are used to mean the same as "image forming".

In this disclosure, the term "image forming apparatus" refers to an apparatus for forming an image by spraying liquid on a medium made of material such as paper, thread, fiber, cloth, leather, metal, plastics, glass, wood, and ceramic. Further, the term "image forming" not only means attaching to a medium an image having semantic meanings such as characters and graphics, but also means attaching to a medium an image having no semantic meanings such as random patterns. Moreover, the term "ink" is not limited to ink in the narrow sense of the word, but refers to any liquid such as ink, resist, and DNA samples that can be used to "form image" in the sense of the term as described above.

In such image forming apparatuses (which may hereinafter be referred to as "inkjet printing apparatuses"), a sub-tank (also referred to as a buffer tank) for supplying ink to a printhead may be mounted on a carriage, while a main ink cartridge (also referred to as a main tank) may be mounted on an immovable part of the apparatus, such that the sub-tank is refilled with ink supplied from the ink cartridge. Alternatively, an ink cartridge that is an exchangeable liquid reservoir may be mounted together with a printhead.

In order to stabilize the spraying of ink droplets from a liquid spray head, it is vitally important to maintain the ink in the liquid spray head at a predetermined negative pressure (i.e., maintain the pressure applied to the ink inside the liquid spray head to a predetermined negative pressure). To this end, a negative pressure generating means is generally provided in the ink supply system that supplies ink to the liquid spray head. With this configuration, ink to which a negative pressure is applied by the negative pressure generating means is supplied to the liquid spray head.

The negative pressure generating means may generate a negative pressure by utilizing capillary suction by a spongy ink absorber contained in an ink cartridge, or may use an urging means such as a spring to outwardly urge an elastic material forming part of the ink cartridge to maintain a negative pressure inside the ink cartridge. Another type of negative pressure generating means has an ink cartridge positioned below the liquid spray head to apply a negative pressure to the ink by utilizing a water head difference.

In typical image forming apparatuses using a sub-tank, the supply passageway to supply ink from an ink cartridge to a sub-tank may be implemented as a flexible resin tube to increase latitude in installment and assembly inside the apparatus and maintainability. Further, an elastic film may be provided as a negative pressure generating means for the sub-tank. The use of an elastic film, however, gives rise to a problem in that the film may allow air passage through long-term use, resulting in air being introduced into the sub-tank. Moreover, air present inside the main tank, air introduced into the supply passageway at the time of installment of the main tank, and air dissolved in the ink may find their way into the sub-tank through the supply passageway to be accumulated in the sub-tank.

Patent Document 1 discloses providing a vent-to-atmosphere valve to switch the internal space of the sub-tank between a closed state and an open state and providing a vent passageway separately from an ink supply passageway to vent air inside the sub-tank, thereby preventing air accumulation in the sub-tank. This vent-to-atmosphere valve includes a valve seat made of an elastic material situated inside a vent-to-atmosphere cap, an iron ball serving as a valve plug, and a spring for urging the iron ball against the valve seat. The spring constantly urges the iron ball to maintain a closed state, thereby preventing the sub-tank from communicating to the open atmosphere, and preventing air from being introduced into the sub-tank. Further, a vent-to-atmosphere pin may be inserted into a holder to move the iron ball against the resisting urge applied by the spring to achieve an open state, thereby making the sub-tank communicate with the open atmosphere. In this state, ink is supplied to the internal space of the sub-tank to replace the air accumulated inside the sub-tank, ejecting the air from the sub-tank.

Patent Document 2 discloses providing an atmosphere introducing meander passageway and a valve along the atmosphere introducing passageway for the purpose of adjusting the pressure inside the tank.

Patent Document 3 discloses providing a filter that prevents dust and dirt from entering a tank when the tank communicates with the atmosphere.

The provision of a vent-to-atmosphere mechanism (valve) as described in Patent Document 1 makes it possible to vent air from a sub-tank to the atmosphere when ink is supplied from the main tank to the sub-tank. Further, the sub-tank is properly sealed for the purpose of maintaining a negative pressure after the ink is supplied to the sub-tank.

When the air-to-atmosphere valve of the sub-tank is opened at the time of initially supplying ink to the liquid spray head for the first time after shipment or at the time of recreating a negative pressure upon performing a maintenance work for recovering the nozzle function by a user, air in the atmosphere is sucked into the sub-tank upon communicating to the atmosphere because the interior space of the sub-tank is substantially in a hermetically sealed state. Due to the suction of air, dust and foreign material present in the atmosphere may enter the sub-tank through the vent-to-atmosphere valve.

If foreign material (including dust) enters the sub-tank to be mixed into the ink inside the tank, the printhead for forming image may suffer trouble such as a spray failure. Also, the contamination of the valve seat and valve plug constituting the vent-to-atmosphere valve by dust and foreign material causes deterioration in the airtightness of the valve, resulting in difficulties in recovering a hermetically-sealed state in the sub-tank. This may make it impossible to generate a negative pressure inside the sub-tank. As a result, ink may drip from the nozzles of the printhead to smear a print sheet and/or make it impossible to properly form images. When this happens, a recovery operation to discharge ink from the nozzles of the liquid spray head by use of a suction pump is necessary in order to reinstate a negative pressure. This is problematic because ink is wasted by the sucking operation to reinstate a negative pressure.

It should be noted that Patent Document 1 discloses applying grease to improve the airtightness of the valve. However, this may further deteriorate the airtightness since dust and foreign material in the atmosphere getting attached to the grease upon opening the valve may permanently remain.

In the configuration disclosed in Patent Document 2, the atmosphere introducing passageway is serpentine. When ink is supplied to the sub-tank, therefore, the pressure inside the sub-tank does not promptly reach the pressure of the atmosphere due to resistance along the serpentine passage way. This gives rise to a problem in that the ink supply time becomes lengthy.

Patent Document 3 discloses providing a filter for a valve. Since the filter is not provided on the same side of the valve as the atmosphere, it is not possible to remove dust and foreign material attached to the valve plug and valve seat.

Accordingly, there is a need to improve the airtightness of a liquid reservoir provided with a vent-to-atmosphere mechanism.

[Patent Document 1] Japanese Patent Application Publication No. 2005-169674

[Patent Document 2] Japanese Patent No. 3772859

[Patent Document 3] Japanese Patent Application Publication No. 2006-272900

DISCLOSURE OF INVENTION

It is a general object of at least one embodiment of the present invention to provide a liquid tank and an image forming apparatus that substantially obviate one or more problems caused by the limitations and disadvantages of the related art.

In one embodiment, a liquid tank includes a vent-to-atmosphere mechanism configured to open and close a vent-to-atmosphere passageway for venting an internal reservoir space connected to a liquid spray head to atmosphere, the vent-to-atmosphere mechanism including a cylindrical member, a valve seat disposed inside the cylindrical member, a valve plug disposed inside cylindrical member and movable to come in contact with or separate from the valve seat, a movable member disposed inside the cylindrical member on an atmosphere side of the valve plug in a slidable manner to cause a movement of the valve plug, the movable member having an outer surface in movable contact with an inner surface of the cylindrical member and having a communication passageway formed therethrough for communication with atmosphere, and a filter member disposed at the communication passageway to capture foreign material.

According to this embodiment, the filter member captures foreign material such as dust and paper particles in the atmosphere, thereby preventing the foreign material from attaching to the valve plug and the valve seat to improve airtightness.

In another embodiment, a liquid tank includes a vent-to-atmosphere mechanism configured to open and close a vent-to-atmosphere passageway for venting an internal reservoir space connected to a liquid spray head to atmosphere, the vent-to-atmosphere mechanism including a cylindrical member, a valve seat disposed inside the cylindrical member, a valve plug disposed inside cylindrical member and movable to come in contact with or separate from the valve seat, a movable member disposed inside the cylindrical member on an atmosphere side of the valve plug in a slidable manner to cause a movement of the valve plug, the movable member having an outer surface in movable contact with an inner surface of the cylindrical member, and the outer surface of the movable member and the cylindrical member forming a communication passageway therebetween for communication with atmosphere, and a cover member disposed between the cylindrical member and the movable member to provide cover, the cover member having a plurality of pores.

According to this embodiment, the cover member captures foreign material such as dust and paper particles in the atmosphere, thereby preventing the foreign material from attaching to the valve plug and the valve seat to improve airtightness.

According to at least one embodiment of the invention, an image forming apparatus having the liquid tank can prevent incursion of air from the atmosphere due to drop in airtightness of the liquid tank, thereby ensuring efficient and stable liquid supply.

BEST MODE FOR CARRYING OUT THE INVENTION

Figure 1:
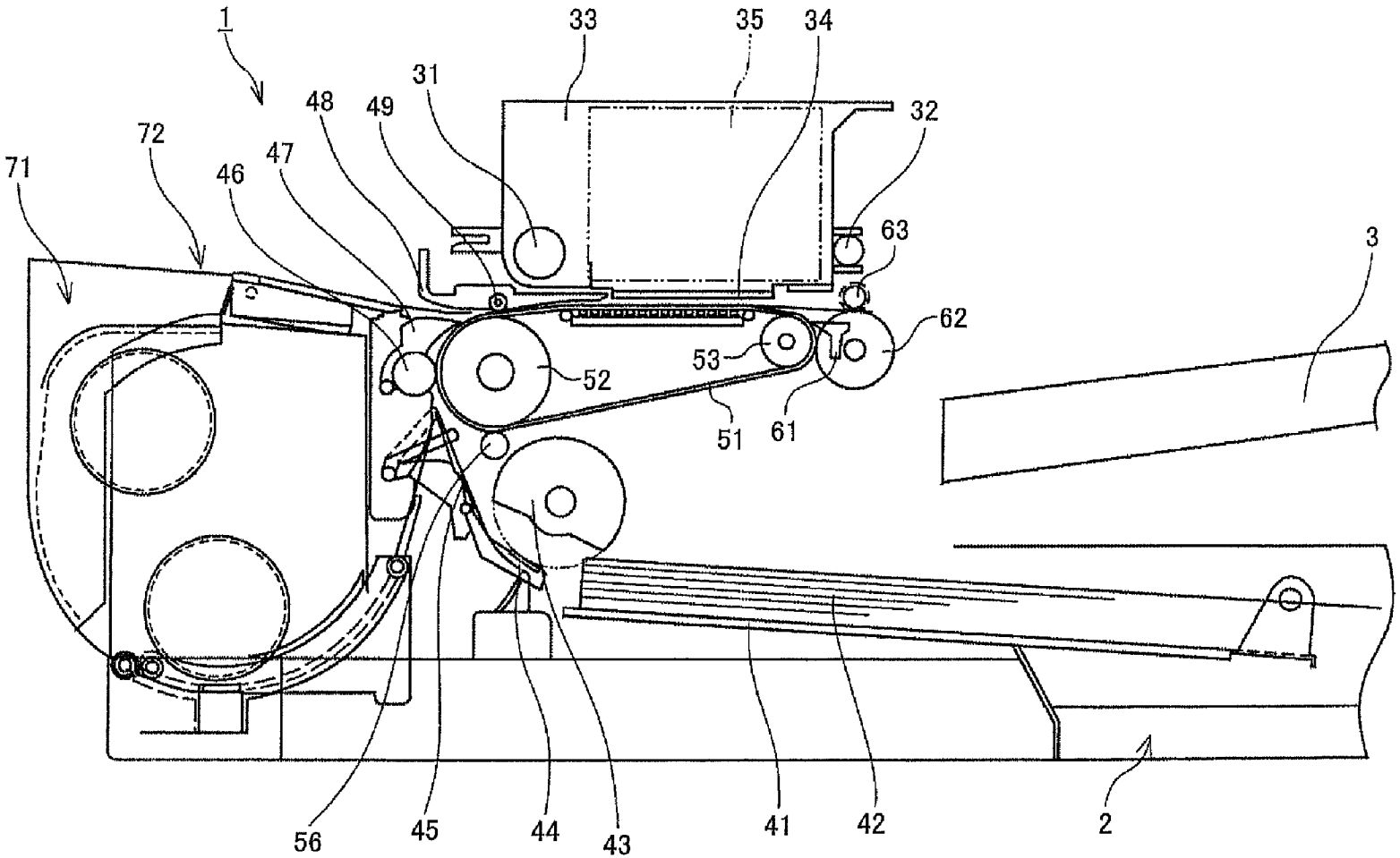
FIG. 1 is a side view showing an entire configuration of the operating part of an image forming apparatus including a liquid spray device according to the present invention.
Figure 2:
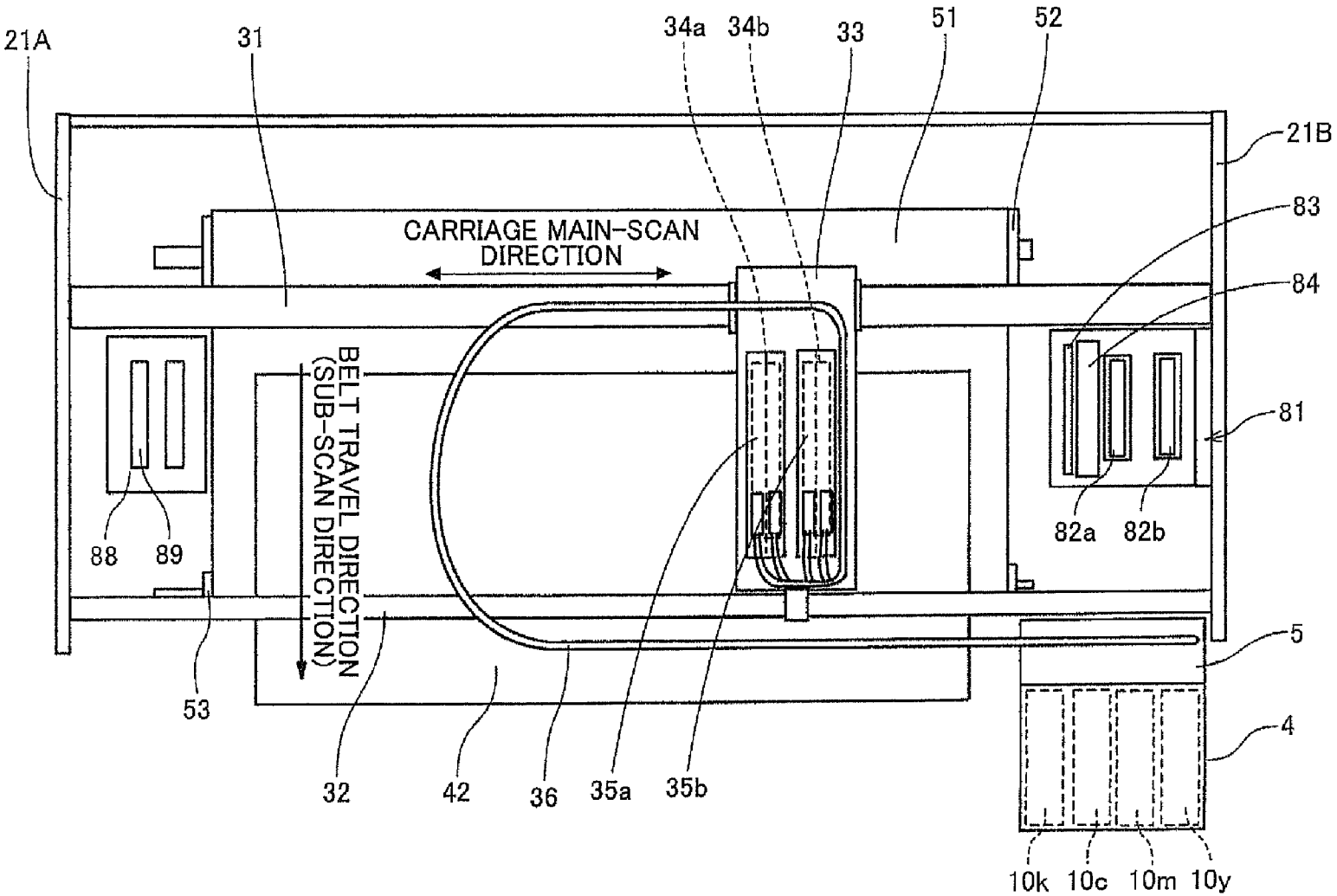
FIG. 2 is a plan view showing main parts of the image forming apparatus.

In the following, embodiments of the present invention will be described with reference to the accompanying drawings. An example of an image forming apparatus according to the present invention will be described by referring to FIG. 1 and FIG. 2. FIG. 1 is a side view showing the entire configuration of an image forming apparatus. FIG. 2 is a plan view showing main parts of the image forming apparatus.

The image forming apparatus is a serial-type image forming apparatus, which has main and auxiliary guide rods 31 and 32 serving as guide members placed horizontally between the left and right side plates 21A and 21B of an apparatus 1. The guide rods 31 and 32 carry a carriage 33 that is movable in a main scan direction. A main scan motor (not shown) drives the carriage 33 though a timing belt in a main carriage-scan direction indicated by an arrow in FIG. 2.

The carriage 33 has printheads 34*a* and 34*b* (which are referred to as a printhead 34 when there is no need to distinguish individual heads from each other). The printheads 34*a* and 34*b* include liquid spray heads for spraying ink droplets of respective colors corresponding to yellow (Y), cyan (C), magenta (M), and black (K). Nozzle lines each comprised of a plurality of nozzles arranged in a sub-scan direction perpendicular to the main scan direction are placed in such a position to spray ink droplets downwardly.

Each printhead 34 has two nozzle lines. One of the two nozzle lines of the printhead 34*a* ejects droplets of black (K) ink, and the other nozzle line ejects droplets of cyan (C) ink. One of the two nozzle lines of the printhead 34*b* ejects droplets of magenta (M) ink, and the other nozzle line ejects droplets of yellow (Y) ink. The configuration of the printhead 34 is not limited to the configuration as described above. Alternative arrangement may be made such that three or four nozzle lines, or even more nozzle lines, are provided on a single nozzle plate.

The carriage 33 also carries sub-tanks 35*a* and 35*b* (which are referred to as a sub-tank 35 when there is no need for distinction) corresponding to the nozzle lines of the printhead 34 for the purpose of supplying color inks. Print liquid cartridges 10*y*, 10*m*, 10*c*, and 10*k* for respective colors are removably mounted on a cartridge mount part 4. A supply pump unit 5 supplies print liquids of respective colors from the print liquid cartridges 10*y*, 10*m*, 10*c*, and 10*k* to the sub-tanks 35 through supply tubes 36 for respective colors.

A crescent roller (i.e., paper feeder roller) 43 and a separation pad 44 having a high friction coefficient is provided as a paper feeder unit for feeding paper sheets 42 placed on a paper sheet stack unit (i.e., pressure plate) 41 of a paper feeder tray 2. The separation pad 44 is opposed to the crescent roller 43 that feeds the paper sheets 42 one by one from the paper sheet stack unit 41. The separation pad 44 is urged against the crescent roller 43.

The paper sheets 42 supplied from the paper feeding unit are carried to under the printhead 34. To this end, a guide member 45 for guiding the paper sheets 42, a counter roller 46, a conveyer guide member 47, and a pressure member 48 having a tip pressuring roller 49 are provided. Further, a conveyer belt 51 is provided as a conveyer means to convey the supplied paper sheets 42 through the position facing the printhead 34 by holding the paper sheets 42 through an electrostatic force.

The conveyer belt 51 is a loop belt that is stretched between a conveyer roller 52 and a tension roller 53 to rotate in a belt travel direction (i.e., sub-scan direction). A charge roller 56 serves as a charge means to electrically charge the surface of the conveyer belt 51. The charge roller 56 is placed in contact with the surface of the conveyer belt 51 to rotate in accordance with the rotation of the conveyer belt 51. The conveyer belt 51 rotates in the belt travel direction as shown in FIG. 2 by the rotation of the conveyer roller 52, which is driven by a sub-scan motor (not shown) through a timing belt.

Further, a paper discharge unit is provided for the purpose of ejecting the paper sheets 42 on which printing is performed by the printheads 34. The paper discharging unit includes a separation nail 61 for separating each paper sheet 42 from the conveyer belt 51 and discharging rollers 62 and 63. A paper discharge tray 3 is placed below the discharging roller 62.

A duplex unit 71 is removably mounted on the back side of the apparatus 1. The duplex unit 71 receives a paper sheet 42 that is returned by reversed rotation of the conveyer belt 51, and flips over the sheet for provision to a gap between the counter roller 46 and the conveyer belt 51. The upper surface of the duplex unit 71 accommodates a manual feeder tray 72.

A maintenance and recovery mechanism 81 is placed in a non-printing area situated on one side of the carriage 33 in the main scan direction to maintain and recover the operating state of the nozzles of the printheads 34. The maintenance and recovery mechanism 81 includes cap members 82*a* and 82*b* (which are referred to as a cap member 82 when there is no need for distinction), a wiper blade 83, and a waste droplet receiving part 84. The cap members 82*a* and 82*b* (which will hereinafter be referred to simply as "cap") serves to cap each nozzle face of the printheads 34. The wiper blade 83 serves to wipe the nozzle face. The waste droplet receiving part 84 receives droplets when droplets not used for printing are ejected for the purpose of ejecting print liquid having increased viscosity.

Further, a collecting unit (waste droplet receiving part) 88 is provided in a non-printing area on the other side of the carriage 33 in the main scan direction to receive droplets when droplets not used for printing are ejected for the purpose of ejecting print liquid having increased viscosity during a printing operation. The collecting unit 88 has an opening 89 extending in the same direction as the extension of a nozzle line of the printheads 34.

In the image forming apparatus having the configuration as described above, the paper sheets 42 are fed one by one from the paper feeder tray 2. A paper sheet 42 traveling upwards substantially in a vertical direction is then guided by the guide member 45 into a gap between the conveyer belt 51 and the counter roller 46. The tip of the paper sheet 42 is further guided by the conveyer guide member 47 to be urged against the conveyer belt 51 by the tip pressuring roller 49, so that the travel direction of the paper sheet 42 turns almost 90 degrees.

An alternating voltage that has positive polarity and negative polarity alternating in turn is applied to the charge roller 56. As a result, the conveyer belt 51 has an alternating charge voltage pattern. That is, the conveyer belt 51 is charged to alternating polarities (i.e., plus and minus), each of which occupies a band-shape surface area having a predetermined width, so that the alternating polarity bands are arranged in turn in the sub, scan direction, which corresponds to the direction of the rotation. When a paper sheet 42 is supplied to the conveyer belt 51 that is charged to alternating positive and negative polarities, the paper sheet 42 is stuck to the conveyer belt 51, so that the paper sheet 42 is conveyed in the sub scan direction by the rotation of the conveyer belt 51.

The printheads 34 are driven by image signals while the carriage 33 is moved. Ink droplets are thus sprayed onto the paper sheet 42 that is staying still to print an image for one line. The printing of the next line is performed after shifting the paper sheet 42 a predetermined distance. In response to a print completion signal or a signal indicative of the tail end of the paper sheet 42 reaching the print area, the print operation comes to an end, followed by discharging the paper sheet 42 to the paper discharge tray 3.

Figure 3:
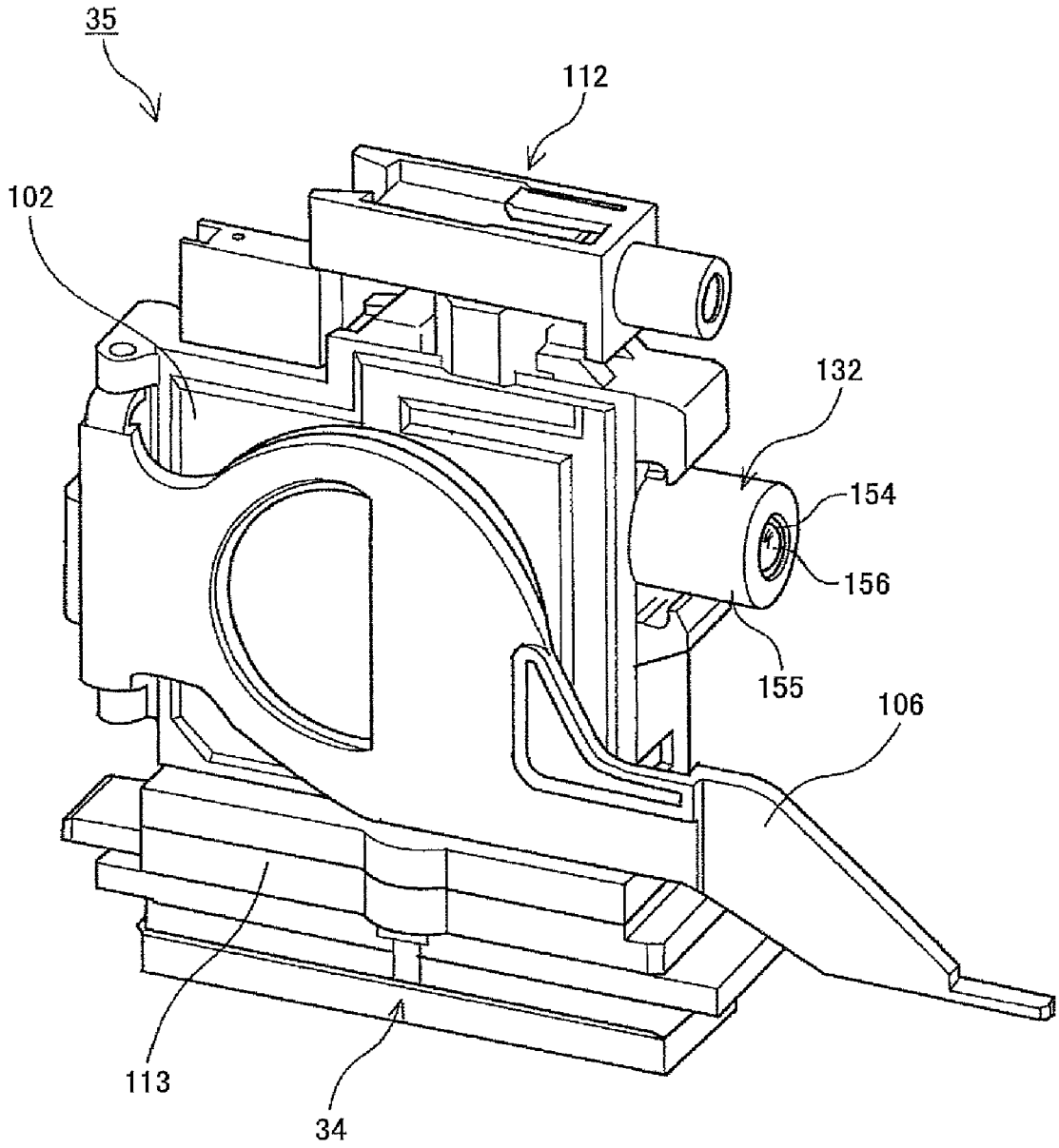
FIG. 3 is a perspective view showing the head unit of the image forming apparatus for explaining liquid reservoirs (sub-tanks).
Figure 4:
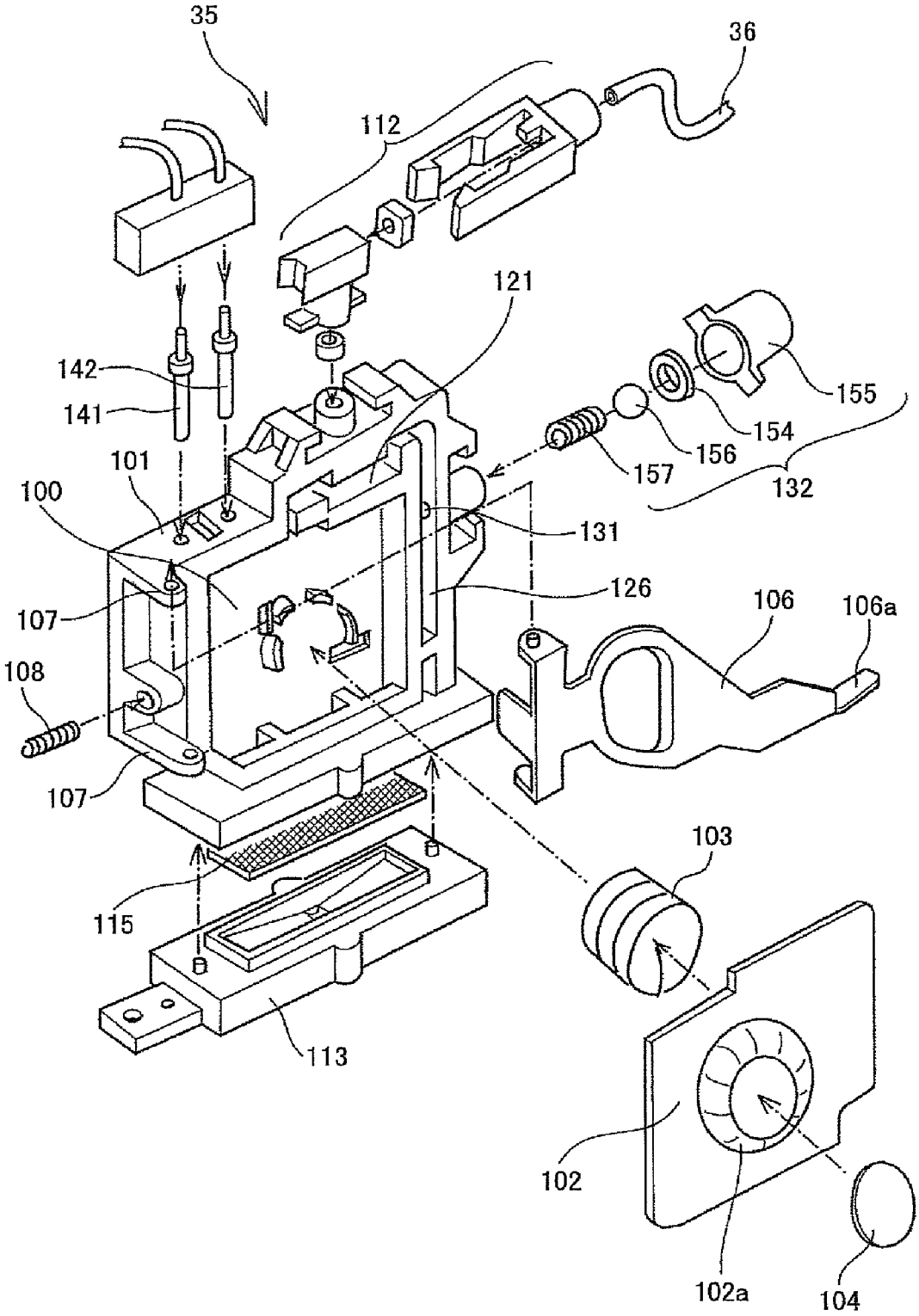
FIG. 4 is an exploded perspective view showing the head unit of the image forming apparatus.
Figure 5:
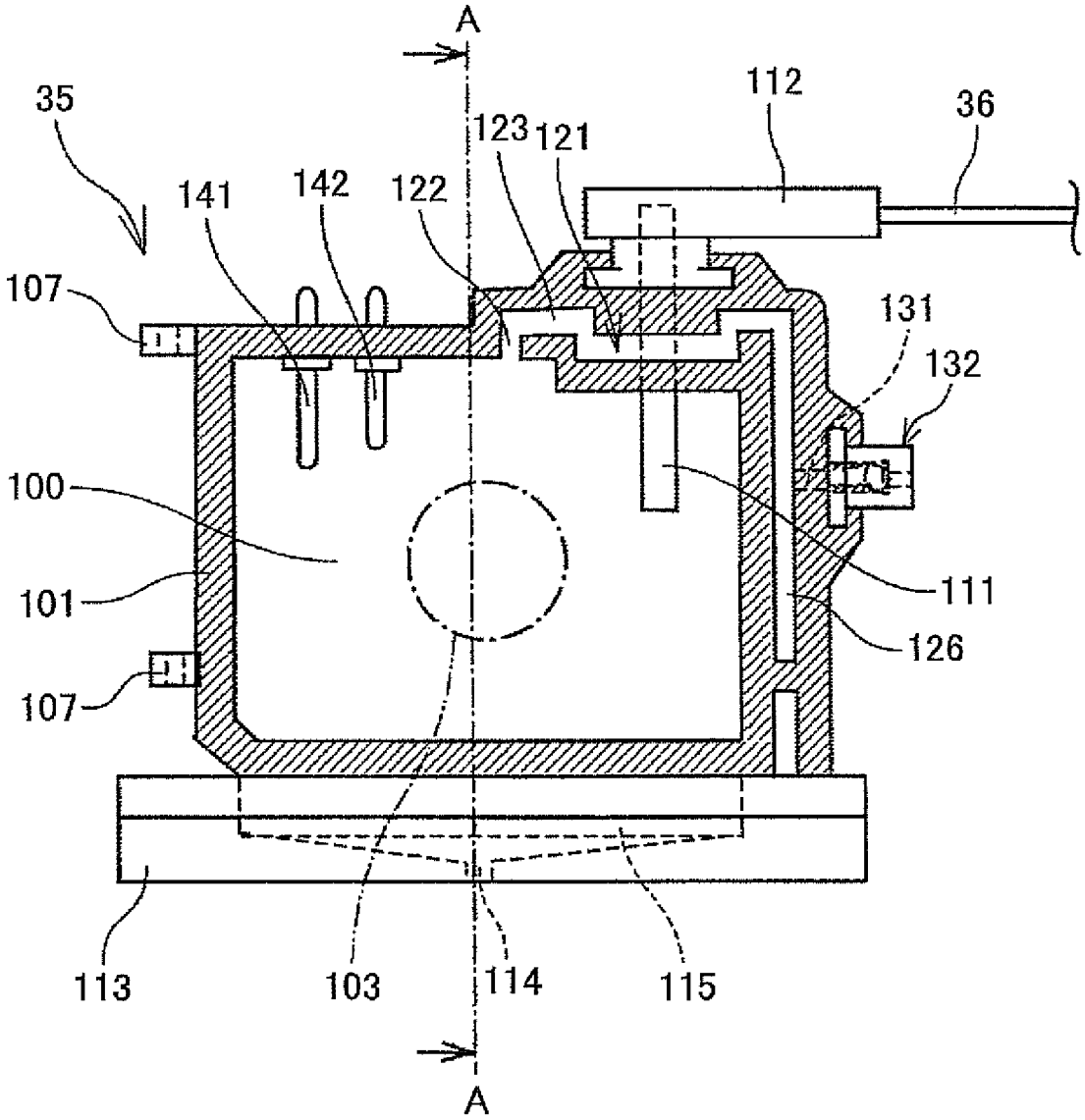
FIG. 5 is an illustrative side view showing the head unit of the image forming apparatus.
Figure 6:
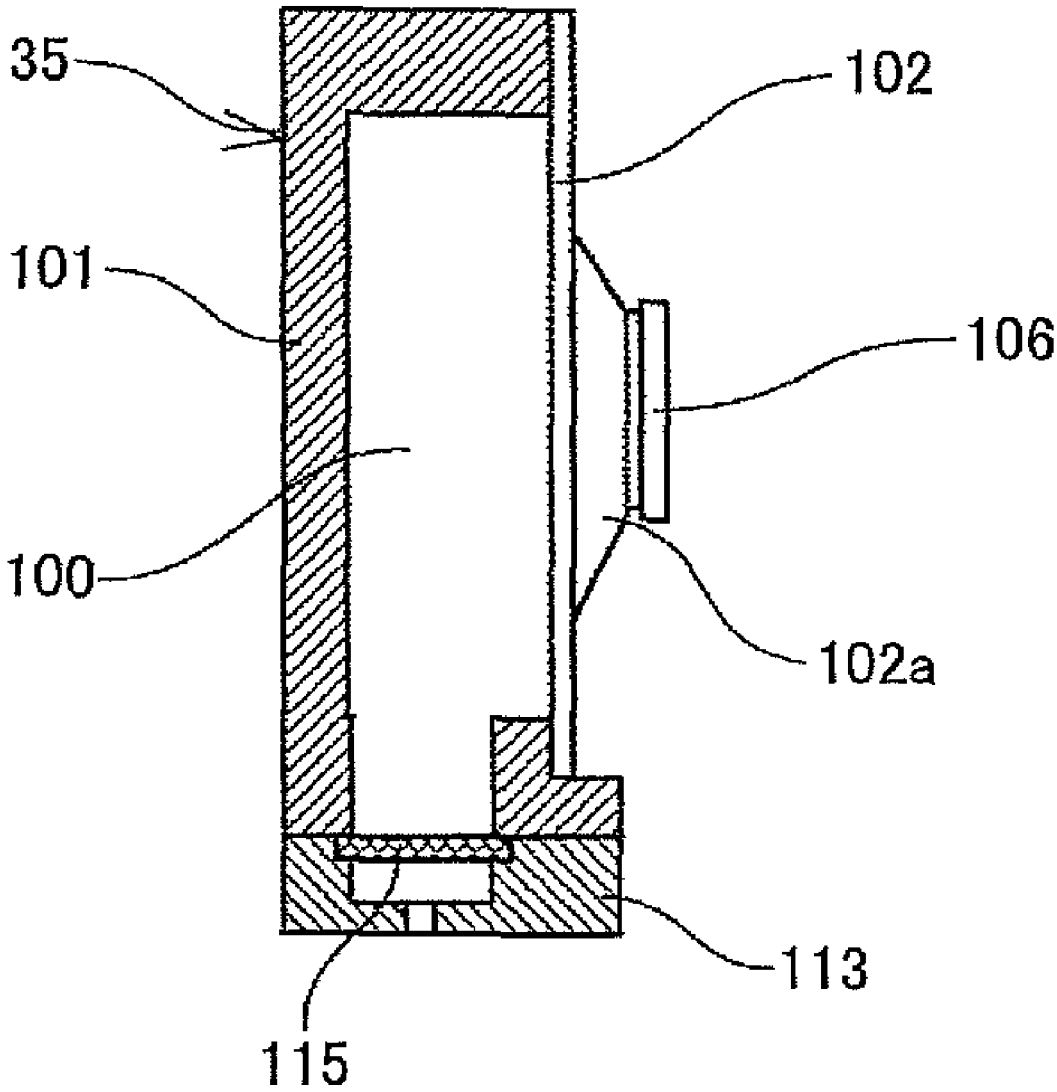
FIG. 6 is a cross-sectional view of the sub-tank taken along a line A-A shown in FIG. 5.

In the following, an example of the sub-tank 35 will be described by referring to FIG. 3 through FIG. 6. FIG. 3 is a perspective view showing the appearance of the sub-tank. FIG. 4 is an exploded perspective view of the sub-tank. FIG. 5 is an illustrative side view of the sub-tank. FIG. 6 is a cross-sectional view of the sub-tank taken along a line A-A shown in FIG. 5. For the sake of simplicity of illustration, the following description will be given with respect to a sub-tank configuration in which the printhead 34 sprays droplets of a single color. In the configuration in which the printhead sprays droplets of two colors as in the image forming apparatus described above, two sub-tanks are formed integrally as a single unitary structure.

The sub-tank 35 includes a case 101 forming an ink reservoir 100 that stores ink serving as print liquid. A film member (elastic film member) 102 having elasticity to seal the opening of the ink reservoir 100 (which is one of the faces of the sub-tank 35) is adhesively fixed to the case 101. Inside the ink reservoir 100, a spring 103 is provided between the case 101 and the film member 102 to outwardly urge the film member 102.

The film member 102 has an expandable portion 102*a* that projects like a bump in response to the spring 103. A reinforcement member 104 is attached to the outer surface of the expandable portion 102*a*. A sensing lever 106, which is displaced in response to a displacement of the film member 102, is movably attached to support members 107, which are formed at one side of the case 101.

The case 101 further has an ink introducing passageway 111 for refilling the ink reservoir 100 with ink. A connecting unit 112 can be removably attached to connect between the ink introducing passageway 111 and a supply tube 36 connected to a print liquid cartridge 10.

A connecting member 113 is attached to the bottom of the case 101 for the purpose of supplying ink from the ink reservoir 100 to the printhead 34. An ink supply passageway 114 is formed through the connecting member 113, and accommodates a filter 115 that separates the rest of the ink supply passageway 114 from the ink reservoir 100.

An air passageway 121 is formed at the top of the case 101 to vent air from the ink reservoir 100. The air passageway 121 includes an inlet passageway 122 communicating with the ink reservoir 100 and a middle passageway 123 connected to the inlet passageway 122. The air passageway 121 communicates with a vent-to-atmosphere hole 131 formed in the case 101 on the downstream, and further includes an accumulation space 126 positioned below the vent-to-atmosphere hole 131 in the state in which the sub-tank 35 is used.

A vent-to-atmosphere valve mechanism 132 is provided to open and close the vent-to-atmosphere hole 131 to switch the sub-tank 35 between a hermetically-sealed state and a vent-to-open-atmosphere state through the vent-to-atmosphere hole 131.

Two sensing electrodes 141 and 142 are attached to the top of the case 101 for the purpose of sensing whether the amount of gas (air) inside the sub-tank 35 has exceeded a predetermined amount (or whether the amount of remaining ink has dropped below a predetermined amount). The amount of gas (or the amount of ink) can be sensed by detecting a change in the electrical connection between the sensing electrodes 141 and 142. The electrical connection differs between the situation in which both of the sensing electrodes 141 and 142 are immersed in ink and the situation in which only one of the sensing electrodes 141 and 142 is immersed in ink.

Figure 7:
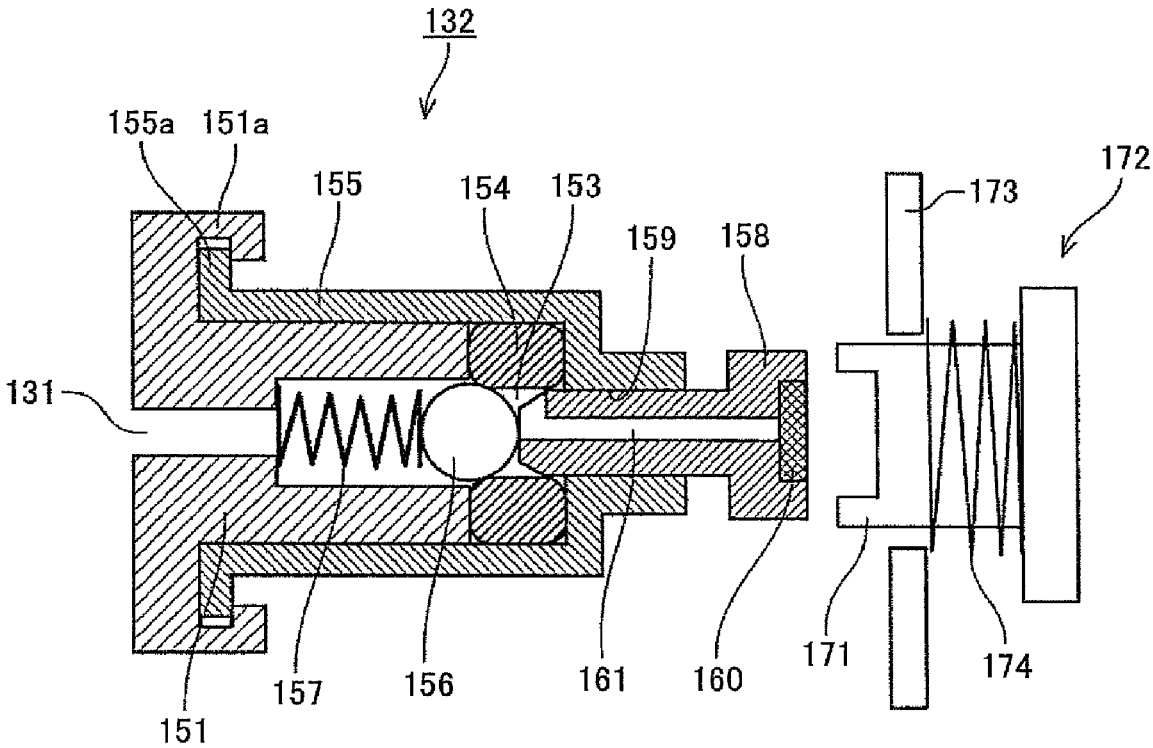
FIG. 7 is an enlarged cross-sectional view of a sub-tank vent-to-atmosphere mechanism according to a first embodiment.

In the following, a description will be given of a first embodiment of the vent-to-atmosphere valve mechanism 132 serving as an on-off valve for the sub-tank 35 by referring to FIG. 7. FIG. 7 is a cross-sectional view showing the detail of the vent-to-atmosphere valve mechanism 132.

A cylindrical holder unit 151 is formed around the vent-to-atmosphere hole 131 of the case 101. A packing member 154 is compressed and fixedly held by a vent-to-atmosphere cap 155 at the tip of the cylindrical holder unit 151. The packing member 154 has an opening 153 for receiving a valve plug. The vent-to-atmosphere cap 155 is fixedly mounted by engaging a securing member 155*a* in an engaging member 151*a* of the case 101.

A ball-shape member 156 is provided in the cylindrical holder unit 151 as a valve plug that can come in contact with or separate from the packing member 154. The ball-shape member 156 is urged by a spring 157 in such a direction as to close the opening 153 of the packing member 154. The packing member 154 may be made of elastic material such as rubber in order to ensure sufficient sealing performance when the ball-shape member 156 is urged against the packing member 154. Such elastic material may preferably be butyl rubber that has superior distortion performance. When the spring 157 urges the ball-shape member 156 serving as a valve plug against the packing member 154, the packing member 154 distorts by the pressure to adhere tightly to the ball-shape member 156. If the distortion stays unchanged, however, airtightness may be undermined when the valve is closed the second time. The use of butyl rubber having superior recovering characteristics (distortion performance) can maintain high adhesion performance upon repeating the closing and opening of the valve, thereby ensuring a high airtightness.

A vent-to-atmosphere movable member 158 is slidably attached to the vent-to-atmosphere cap 155 on the same side of the ball-shape member 156 as the atmosphere. The vent-to-atmosphere movable member 153 has a cylindrical shape, and can urge the ball-shape member 156 in such a direction to open the valve. The outer surface of the vent-to-atmosphere movable member 158 is engaged in an opening 159 of the vent-to-atmosphere cap 155 in a slidable manner. An air pipe path 161 is formed through the vent-to-atmosphere movable member 158. One end of the air pipe path 161 on the atmosphere side is provided with a filter 160 that captures foreign material. The other end of the air pipe path 161 faces the opening 153 of the packing member 154.

A drive actuator 172 is provided to open and close the ball-shape member 156 serving as a valve plug, and has a plunger 171 that is pressed by an external drive mechanism (not shown). The plunger 171 exhibits sliding motion by a return spring 174 situated between the plunger 171 and a frame 173 of the drive actuator 172. With such a configuration, the plunger 171 pushes the vent-to-atmosphere movable member 158, which forces to move the ball-shape member 156 against the resisting urge of the spring 157, thereby placing the opening 153 in an open state.

In this configuration, the vent-to-atmosphere valve mechanism 132 is operated by inwardly moving the plunger 171 to push the ball-shape member 156 serving as a valve plug, thereby opening the opening 153 to make the vent-to-atmosphere hole 131 communicate with the open atmosphere. The interior space of the sub-tank 35 is thus connected to the atmosphere through the vent-to-atmosphere hole 131 and the air pipe path 161. It should be noted that the interior space of the sub-tank 35 has been placed at negative pressure. Accordingly, airflow occurs that sucks air into the sub-tank 35 upon opening the ball-shape member 156 serving as a valve plug.

The outer surface of the vent-to-atmosphere movable member 158 is engaged in the opening 159 to leave no space therebetween. Upon establishing vent to the atmosphere, therefore, air does not flow between the outer surface of the vent-to-atmosphere movable member 158 and the inner surface of the opening 159. Accordingly, the communication between the interior space of the sub-tank 35 and the open atmosphere upon opening the vent-to-atmosphere valve mechanism 132 only occurs through the air pipe path 161 via the filter 160 mounted in the vent-to-atmosphere movable member 158.

Since the airflow occurring to suck air from the atmosphere into the sub-tank 35 passes through the filter 160, dust and foreign material in the atmosphere are captured by the filter 160, failing to enter the space where the ball-shape member 156 is situated. Further, the provision of the air pipe path 161 can stabilize the amount of airflow that occurs upon establishing vent to the atmosphere. In this case, the air inside the sub-tank 35 is released to the open atmosphere through the vent-to-atmosphere hole 131 and air pipe path 161 of the vent-to-atmosphere valve mechanism 132 when the sub-tank 35 is filled with ink under the vent-to-atmosphere condition.

Typically, a gap between a movable member and an opening into which the movable member fits is made large, so that such a large gap is utilized to establish communication to the open atmosphere. In the above-described configuration, on the other hand, the use of the air pipe path 161 ensures that the passageway through which air flows has a constant shape. Even if valve operations are repeatedly performed, the amount of airflow will be constant and stable. Further, the adjustment of the diameter size of the air pipe path 161 makes it possible to achieve a desired amount of airflow according to need.

With the arrangement as described above, the intrusion of dust and foreign material into the sub-tank 35 is reduced, and so is the contamination by dust and foreign material of the ball-shape member 156 serving as a valve plug and the packing member 154 serving as a valve seat in the vent-to-atmosphere valve mechanism 132. This prevents image degradation that would be caused by the failure of the printhead 34 to properly spray droplets upon the intrusion of dust and foreign material into the sub-tank 35. Further, tight adhesion between the ball-shape member 156 and the packing member 154 in the vent-to-atmosphere valve mechanism 132 is maintained, thereby ensuring the hermitically-sealed condition of the sub-tank 35 upon repeated uses. Moreover, the reliability of open/close operations of the valve is improved, which makes it possible to stably supply ink at the time of ink replenishment. Further, since there is almost no gap between the movable member and the opening (of the vent-to-atmosphere cap), the unstable sliding movement of the vent-to-atmosphere movable member 158 due to its looseness is prevented. The ball-shape member 156 serving as a valve plug can thus be securely closed. Accordingly, the stability and reliability of the vent-to-atmosphere operation are improved.

In addition, the interface between the vent-to-atmosphere movable member 158 and the opening 159 of the vent-to-atmosphere cap 155 may be made of resin material having small friction. This allows a stable sliding movement based on small friction while making the gap as small as possible. A resin material having small friction may include polyacetal resin, fluorine resin, etc. As a result, the sliding movement of the vent-to-atmosphere movable member 158 is performed smoothly, thereby improving the reliability of the valve open/close operation.

Figure 8:
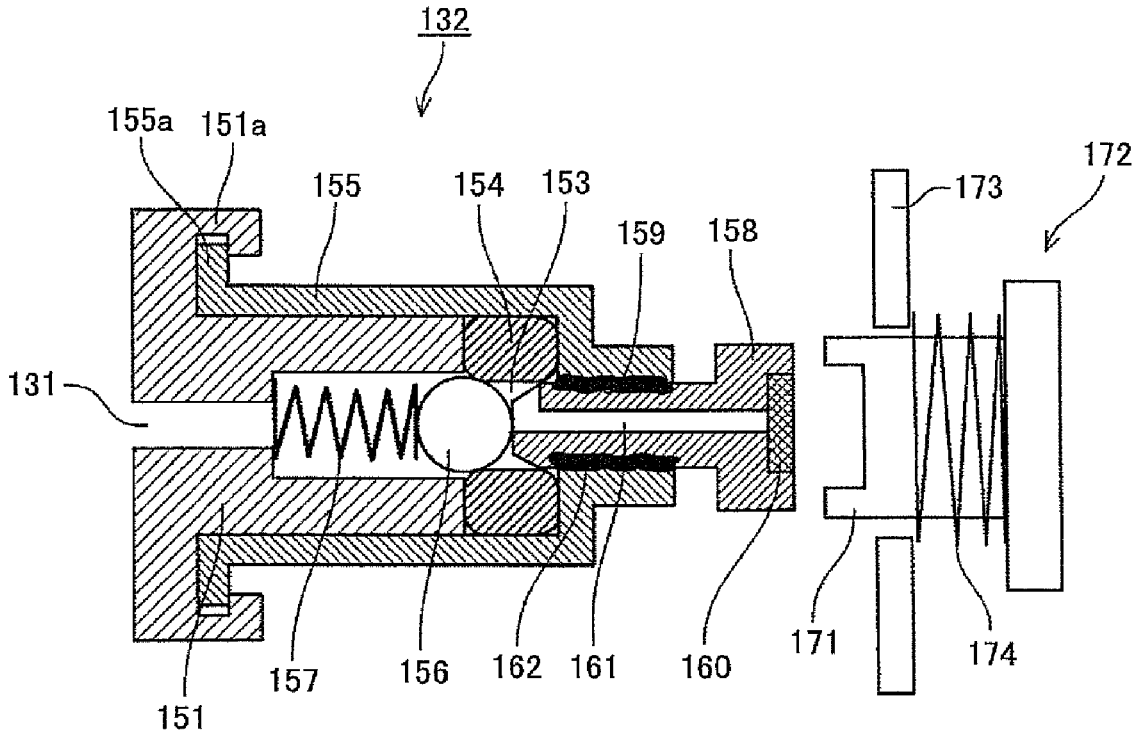
FIG. 8 is an enlarged cross-sectional view of a sub-tank vent-to-atmosphere mechanism according to a second embodiment.

In the following, a second embodiment of the present invention will be described by referring to FIG. 8. FIG. 8 is a cross-sectional view of a sub-tank vent-to-atmosphere mechanism according to the second embodiment.

In this embodiment, an antifriction 162 having high viscosity is disposed between the outer surface of the vent-to-atmosphere movable member 158 and the inner surface of the opening 159 of the vent-to-atmosphere cap 155. The antifriction 162 is provided in places where the vent-to-atmosphere movable member 158 rubs the opening 159 at the time of sliding movement.

With this arrangement, even a minute gap between the outer surface of the vent-to-atmosphere movable member 158 and the inner surface of the opening 159 of the vent-to-atmosphere cap 155 can be closed. This prevents intrusion of fine dust and foreign material from the atmosphere. Further, friction between the movable parts at the time of sliding movement can be reduced, which prolongs the operating life of the vent-to-atmosphere movable member 158 with respect to repetitious sliding movements. The antifriction 162 having high viscosity may include highly viscous liquid grease that includes silicon or fluorine as a base material.

Figure 9:
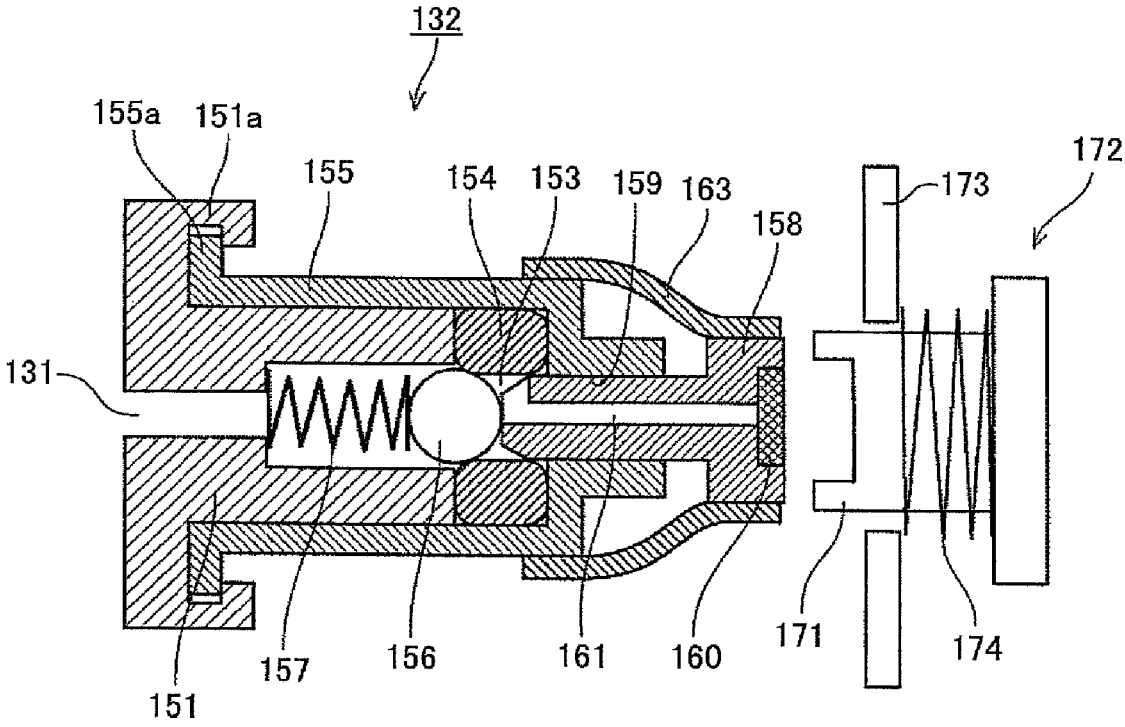
FIG. 9 is an enlarged cross-sectional view of a sub-tank vent-to-atmosphere mechanism according to a third embodiment.

In the following, a third embodiment of the present invention will be described by referring to FIG. 9. FIG. 9 is a cross-sectional view of a sub-tank vent-to-atmosphere mechanism according to the third embodiment.

In this embodiment, a cover member 163 is provided between the outer surface of the vent-to-atmosphere cap 155 and a constantly exposed portion of the vent-to-atmosphere movable member 158 excluding the portion where the filter 160 is attached, thereby securely covering portions in between. The cover member 163 is fixedly attached to the contact surface of the vent-to-atmosphere cap 155 and the contact surface of the vent-to-atmosphere movable member 158. The cover member 163 is formed of an elastic or flexible member, so that the cover member 163 deforms in response to the sliding movement of the vent-to-atmosphere movable member 158 made for the purpose of opening/closing the ball-shape member 156 serving as a valve plug. Namely, the cover member 163 does not hinder the movement of the vent-to-atmosphere movable member 158. An elastic member may be rubber, and a flexible member may be a resin film or the like. The cover member 163 may have an accordion-fold shape as long as it does not hinder the sliding movement of the vent-to-atmosphere movable member 158. In this embodiment, a gap may be allowed to exist between the vent-to-atmosphere movable member 158 and the opening 159, provided that the opening and closing of the vent-to-atmosphere mechanism can securely be performed.

The filter 160 may have a plurality of pores (minute holes) or a mesh shape for the purpose of capturing dust and foreign material present in the atmosphere. In this embodiment, the filter 160 is preferably made of sintered metal fiber, which exhibits a satisfactory dust collecting ability for a long time against filter clogging caused by captured dust and foreign material.

This arrangement can prevent intrusion of fine dust and foreign material through a gap between the outer surface of the vent-to-atmosphere movable member 158 and the inner surface of the opening 159 of the vent-to-atmosphere cap 155.

Figure 10:
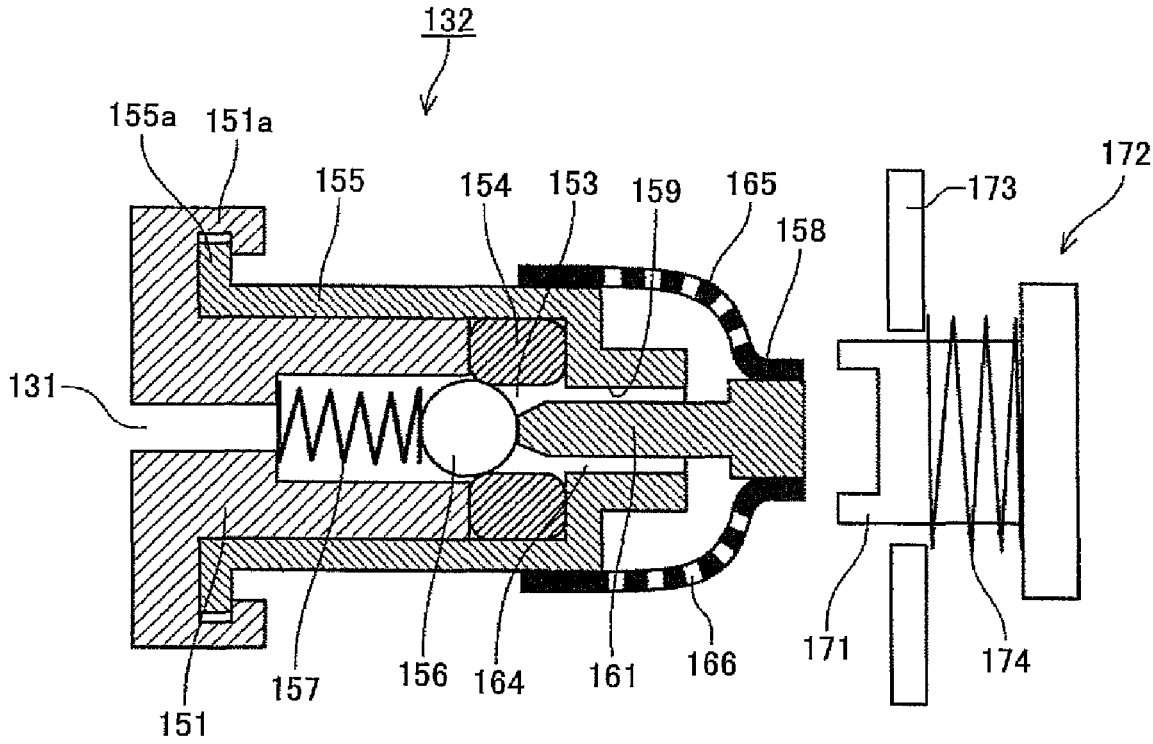
FIG. 10 is an enlarged cross-sectional view of a sub-tank vent-to-atmosphere mechanism according to a forth embodiment.

In the following, a fourth embodiment of the present invention will be described by referring to FIG. 10. FIG. 10 is a cross-sectional view of a sub-tank vent-to-atmosphere mechanism according to the fourth embodiment.

In this embodiment, the vent-to-atmosphere movable member 158 is solid, and does not have the filter 160, different from the configurations of the previous embodiments. A communication path 164 for providing communication between inner space and outer space is provided between the outer surface of the vent-to-atmosphere movable member 158 and the inner surface of the opening 159 of the vent-to-atmosphere cap 155. A cover member 165 is provided between the outer surface of the vent-to-atmosphere cap 155 and a constantly exposed portion of the vent-to-atmosphere movable member 158 to securely cover portions in between, and is fixedly attached to the contact surface of the vent-to-atmosphere cap 155 and the contact surface of the vent-to-atmosphere movable member 158.

As in the third embodiment, the cover member 165 is formed of an elastic or flexible member, so that the cover member 165 deforms in response to the sliding movement of the vent-to-atmosphere movable member 158 made for the purpose of opening/closing the ball-shape member 156 serving as a valve plug. Namely, the cover member 165 does not hinder the movement of the vent-to-atmosphere movable member 158.

The cover member 165 has a plurality of minute holes 166, which serves as a filter to capture dust and foreign material.

In such configuration, the intake of air caused by the negative pressure inside the sub-tank 35 occurs through the minute holes 166 when the ball-shape member 156 serving as a valve plug is moved to open the vent-to-atmosphere valve mechanism 132. The intake air passes through the communication path 164 that is a gap between the vent-to-atmosphere movable member 158 and the opening 159 to flow into the sub-tank 35. In this manner, the sub-tank 35 communicates with the open atmosphere.

The minute holes 166 may deform upon the sliding movement of the vent-to-atmosphere movable member 158, but is positioned such as to maintain their aperture. Since the minute holes 166 captures dust and foreign material, no filter may be provided separately. The cover member 165 may have an accordion-fold shape with the minute holes 166 properly positioned to be exposed to the atmosphere as long as such configuration does not hinder the sliding movement of the vent-to-atmosphere movable member 158.

In this manner, the minute holes formed through the cover member serve as a filter to capture dust and foreign material, and the cover member can deform in response to the sliding movement of the movable member. Such a configuration brings about the same effects and advantages as those of the previously-described embodiments, and can achieve cost reduction and size reduction through the elimination of some assembly components.

The image forming apparatus according to the present invention is not limited to an apparatus having a printer function alone, but may be an image forming apparatus having multi-functions such as printer, facsimile, and copy functions altogether. The liquid tank may be that used in such an image forming apparatus. The configuration of the liquid tank is not limited to that used in the above-described embodiments.

Further, the present invention is not limited to these embodiments, but various variations and modifications may be made without departing from the scope of the present invention.

The present application is based on Japanese priority application No. 2007-271659 filed on Oct. 18, 2007, with the Japanese Patent Office, the entire contents of which are hereby incorporated by reference.

The invention claimed is:

1. A liquid tank comprising a vent-to-atmosphere mechanism configured to open and close a vent-to-atmosphere passageway for venting an internal reservoir space connected to a liquid spray head to atmosphere, the vent-to-atmosphere mechanism including:

a cylindrical member;

a valve seat disposed inside the cylindrical member;

a valve plug disposed inside the cylindrical member and movable to come in contact with or separate from the valve seat;

a movable member disposed inside the cylindrical member on an atmosphere side of the valve plug in a slidable manner to cause a movement of the valve plug, the movable member having an outer surface in movable contact with an inner surface of the cylindrical member and having a communication passageway formed therethrough for communication with atmosphere; and a filter member disposed at the communication passageway to capture foreign material.

2. The liquid tank as claimed in claim 1, further comprising an antifriction disposed between the cylindrical member and the movable member.

3. The liquid tank as claimed in claim 1, wherein the cylindrical member and the movable member are made of resin material.

4. The liquid tank as claimed in claim 1, further comprising a cover member disposed between the cylindrical member and the movable member to provide cover.

5. The liquid tank as claimed in claim 4, wherein the cover member is an elastic or flexible member deformable in concert with a sliding movement of the movable member.

6. An image forming apparatus, comprising:

the liquid tank of claim 1; and the liquid spray head configured to spray droplets of liquid supplied from the liquid tank.

7. A liquid tank comprising a vent-to-atmosphere mechanism configured to open and close a vent-to-atmosphere passageway for venting an internal reservoir space connected to a liquid spray head to atmosphere, the vent-to-atmosphere mechanism including:

a cylindrical member;

a valve seat disposed inside the cylindrical member;

a valve plug disposed inside the cylindrical member and movable to come in contact with or separate from the valve seat;

a movable member disposed inside the cylindrical member on an atmosphere side of the valve plug in a slidable manner to cause a movement of the valve plug, the movable member having an outer surface in movable contact with an inner surface of the cylindrical member, and the outer surface of the movable member and the cylindrical member forming a communication passageway therebetween for communication with atmosphere; and a cover member disposed between the cylindrical member and the movable member to provide cover, the cover member having a plurality of pores.

8. An image forming apparatus, comprising:

the liquid tank of claim 7; and the liquid spray head configured to spray droplets of liquid supplied from the liquid tank.

* * * * *